US008210159B1

(12) United States Patent
Neumaster et al.

(10) Patent No.: US 8,210,159 B1
(45) Date of Patent: Jul. 3, 2012

(54) MULTIPLE EYE PAINTBALL LOADER MOTOR CONTROL

(76) Inventors: Terry Neumaster, Lowell, AR (US); Loy Hoskins, Springdale, AR (US); Keith Hankins, Springdale, AR (US); Mark Whatley, Fayetteville, AR (US)

( * ) Notice: Subject to any disclaimer, the term of this patent is extended or adjusted under 35 U.S.C. 154(b) by 0 days.

(21) Appl. No.: 13/200,181

(22) Filed: Sep. 20, 2011

Related U.S. Application Data

(63) Continuation of application No. 12/011,777, filed on Jan. 29, 2008, now abandoned.

(60) Provisional application No. 60/897,948, filed on Jan. 29, 2007.

(51) Int. Cl.
*F41B 11/02* (2006.01)

(52) U.S. Cl. ..... 124/51.1; 124/49; 124/50; 124/53; 124/56; 221/1; 221/13

(58) Field of Classification Search ..... 124/49, 124/50, 51.1, 53, 56; 221/1, 13
See application file for complete search history.

(56) References Cited

U.S. PATENT DOCUMENTS

| | | | | |
|---|---|---|---|---|
| 5,282,454 | A | 2/1994 | Bell et al. | 124/49 |
| 5,816,232 | A | 10/1998 | Bell | 124/51.1 |
| 6,213,110 | B1 | 4/2001 | Christopher et al. | 124/51.1 |
| 6,418,919 | B1 * | 7/2002 | Perrone | 124/49 |
| 6,502,567 | B1 | 1/2003 | Christopher et al. | 124/51.1 |
| 6,609,511 | B2 | 8/2003 | Kotsiopoulos et al. | 124/51.1 |
| 6,644,293 | B2 | 11/2003 | Jong | 124/52 |
| 6,725,852 | B1 | 4/2004 | Yokota et al. | 124/49 |
| 6,792,933 | B2 | 9/2004 | Christopher et al. | 124/56 |
| 6,807,959 | B1 | 10/2004 | Murdock et al. | 124/61 |
| 6,889,680 | B2 | 5/2005 | Christopher et al. | 124/51.1 |
| 7,021,302 | B2 | 4/2006 | Neumaster et al. | 124/48 |
| 7,343,909 | B2 * | 3/2008 | Christopher et al. | 124/51.1 |
| 7,445,002 | B2 | 11/2008 | Christopher et al. | 124/51.1 |
| 7,594,502 | B1 | 9/2009 | Anderson | 124/71 |
| 7,654,255 | B2 * | 2/2010 | Spicer | 124/51.1 |
| 7,694,669 | B2 * | 4/2010 | Campo | 124/51.1 |
| 7,832,389 | B2 | 11/2010 | Christopher | 124/51.1 |
| 7,841,328 | B2 | 11/2010 | Italia et al. | 124/51.1 |
| 7,921,835 | B2 * | 4/2011 | Campo et al. | 124/51.1 |
| 7,966,999 | B2 * | 6/2011 | Bosch et al. | 124/51.1 |
| 8,047,191 | B2 * | 11/2011 | Christopher et al. | 124/51.1 |
| 8,082,911 | B1 * | 12/2011 | Anderson | 124/48 |
| 2002/0014230 | A1 | 2/2002 | Christopher et al. | 124/56 |
| 2002/0092513 | A1 | 7/2002 | Christopher et al. | 124/56 |
| 2006/0196489 | A1 | 9/2006 | Campo | 124/51.1 |
| 2006/0254572 | A1 | 11/2006 | Hall | 124/74 |
| 2007/0012303 | A1 | 1/2007 | Christopher et al. | 124/41.1 |
| 2007/0012304 | A1 | 1/2007 | van Dorsser et al. | 124/51.1 |

(Continued)

*Primary Examiner* — Gene Kim
*Assistant Examiner* — Alexander Niconovich
(74) *Attorney, Agent, or Firm* — Keisling & Pieper PLC; David B. Pieper

(57) ABSTRACT

A multiple eye paintball loader motor controller having a container and an outfeed tube to direct paintballs to a marker. Ball sensors are in the loader outfeed tube to predict incoming paintballs and the rate of supply. A controller is connected to the ball sensor to sense the incoming balls to control or adapt the operation of the loader in accordance with the supply rate. Secondary sensors may also be utilized to provide additional information. Secondary sensors may be placed in the outfeed tube, placed to provide supplemental side information, or a combination of these placements. Various placements provide feed rate information and may also detect jammed ball positions in the transition area at the end of the outfeed tube.

11 Claims, 5 Drawing Sheets

U.S. PATENT DOCUMENTS

| | | | | |
|---|---|---|---|---|
| 2007/0017494 | A1 | 1/2007 | Andresen | 124/51.1 |
| 2007/0017495 | A1 | 1/2007 | Andresen | 124/51.1 |
| 2007/0113834 | A1 | 5/2007 | Spicer | 124/49 |
| 2007/0137631 | A1 | 6/2007 | Christopher | 124/49 |
| 2007/0175463 | A1 | 8/2007 | Higgins et al. | 124/45 |
| 2007/0246479 | A1 | 10/2007 | Andresen | 221/159 |
| 2008/0047536 | A1 | 2/2008 | Chen | 124/51.1 |
| 2008/0141990 | A1 | 6/2008 | Andresen | 124/51.1 |
| 2008/0216805 | A1* | 9/2008 | Christopher et al. | 124/51.1 |
| 2009/0025700 | A1 | 1/2009 | Andresen | 124/51.1 |
| 2009/0133680 | A1* | 5/2009 | Christopher et al. | 124/51.1 |
| 2009/0241929 | A1 | 10/2009 | Italia et al. | 124/51.1 |
| 2010/0126485 | A1* | 5/2010 | Neumaster | 124/51.1 |
| 2010/0154766 | A1 | 6/2010 | Skilling | 124/71 |
| 2010/0258101 | A1 | 10/2010 | Campo et al. | 124/51.1 |

* cited by examiner

MULTIPLE EYE PAINTBALL LOADER MOTOR CONTROL

CROSS-REFERENCE TO RELATED APPLICATIONS

This application claims priority to and is a continuation of U.S. application Ser. No. 12/011,777 filed on Jan. 29, 2008, now abandoned which claims priority to and is a continuation-in-part of U.S. provisional application Ser. No. 60/897,948, filed Jan. 29, 2007, entitled MULTIPLE EYE PAINTBALL LOADER MOTOR CONTROL.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of paintball. In particular, the present invention relates specifically to a high speed paintball loader using outfeed tube sensing and/or pulse type motor control.

2. Description of the Known Art

The game of paintball has enjoyed great success in recent years. In the game, each of two or more teams tries to capture the opposing team's flag. The players on the teams carry a compressed air-powered marker that shoots paintballs (i.e., gelatin-covered spherical capsules which contain a colored liquid) a considerable distance. When a player is hit with a paintball fired from a marker, the paintball ruptures and leaves a colored mark on the hit player; the hit player must leave the game. As the game of paintball has grown in sophistication, semi-automatic paintball markers (i.e., markers that sequentially fire individual paintballs as fast as the trigger can be repeatedly pulled) have become more prevalent. The high firing rate capability of semi-automatic paintball markers has necessitated the use of bulk paintball loaders in conjunction with such markers. In addition, these markers can demand paintball feed rates that exceed the abilities of a gravity feed system. Thus, powered loaders have been developed.

A conventional bulk paintball loader typically comprises a housing positioned above and slightly to one side of the paintball marker. The housing is adapted to internally store a relatively large number of paintballs and has a bottom outlet opening through which the stored paintballs can sequentially drop. Connected to the housing's bottom outlet opening, and extending downwardly therefrom, is an outfeed tube that is connectable to the paintball marker's hollow infeed tube.

During normal operation of the loader, paintballs dropped through the bottom outlet opening of the housing form a paintball stack within the outfeed tube and marker infeed tube. When the paintball at the bottom of the stack is dropped into the firing chamber of the paintball marker, it is replaced, at the top of the stack, from the supply of paintballs remaining in the loader housing, thereby replenishing the stack. In replenishing the stack of paintballs, however, jams sometimes occur within the loader housing, above its bottom outlet opening. Paintball jams of this nature prevent normal gravity-fed delivery of paintballs downwardly through the bottom outlet opening, with the result that the paintball stack can be totally depleted after several shots of the paintball marker.

One solution for clearing paintball jams involves forcibly shaking the paintball marker and attached loader to dislodge the paintballs that are causing the jam within the loader housing. This solution has proved undesirable as it interrupted the proper aiming of the paintball marker and correspondingly interrupted the paintball marker user's ability to shoot the paintballs continuously and rapidly.

Another solution is presented in U.S. Pat. No. 5,282,454, which is incorporated herein by reference. The '454 patent incorporates a jam clearing system into the paintball loader device. The jam clearing system includes an agitator disposed within the housing near the outlet, and an optical circuit for detecting the absence of paintballs at a specified location within the outfeed tube (i.e., a depleted stack). Upon detection of the absence of a paintball at the specified location within the outfeed tube, the optical circuit would close a switch to turn on a motor, which would cause the agitator to rotate. Agitator rotation usually would eliminate the paintball jam within the loader, allowing paintballs to resume gravity feed into the outfeed tube. This, in turn, would replenish the paintball stack and cause the optical circuit to open the switch and turn off the motor, thus arresting the agitator. While improving delivery of paintballs to the paintball marker, the agitator solution of the '454 patent is not optimal because the agitator simply shuffles paintballs within the loader housing, which are fed only by gravity to the outfeed tube.

Yet another solution for clearing paintball jams is presented in U.S. Pat. No. 5,816,232, which is also incorporated herein by reference. In the "active feed" loader of the '232 patent, a switch controlling a motor-driven impeller is turned on and off by an optical paintball detector in a manner similar to the agitator control in the '454 patent. The impeller of the '232 patent is situated in a surrounding well at the bottom of the loader housing and has curved arms that sequentially move paintballs one-by-one toward the outfeed tube. Similar active-feed paintball loaders are disclosed in U.S. Pat. No. 6,213,110 and U.S. Patent Publication No. US 2002/0014230 A1. In all of these active-feed loaders the impeller is made of a relatively stiff, unyielding material. If the impeller should turn when there is a paintball jam, or when the stack of paintballs in the outfeed tube is static (marker not firing), the stiff impeller can squeeze and undesirably break one or more paintballs in the loader housing. This latter situation can occur if the motor does not shut off due to a malfunction, or during normal operation if motor/impeller rotation is not arrested quickly enough. U.S. Patent Publication No. US 2002/0092513 A1 recognizes this impeller over-running problem, but the solution proposed is a complex and seemingly costly spring mechanism built into the impeller.

U.S. Pat. No. 6,502,567 ("the '567 patent") issued to Christopher, et al. on Jan. 7, 2003 teaches a rapid feed paintball loader for use upon a conventional paintball marker. The rapid feed paintball loader includes a container for holding a plurality of paintballs. At a bottom portion of the container is a rotatable drive cone having a plurality of vertical fins. Each fin forms a gap with an adjacent fin large enough to accommodate a paintball. At the bottom of the container is an exit tube which exits from the bottom portion of the container and leads to an inlet tube of the paintball marker. A tube extension is mounted on an interior surface of the container adjacent to the sloped exit portion of the exit tube. The tube extension is mounted at a height which is above the top feed surface of the fins, and which is approximately equal to the radius of a paintball. A pivotable deflector is also mounted on an interior surface of the container adjacent the tube extension to prevent paintball jams from occurring within the interior of the container. The deflector is positioned above the top feed surface of the fins and below the height of the tube extension. The paintball loader also includes a microprocessor to variably control the rotational speed of the drive cone.

U.S. Pat. No. 6,725,852 issued to Yokota et al. on Apr. 27, 2004 teaches an ammunition magazine for dispensing uniformly-sized spherical projectiles such as paintballs into a marker adapted to shoot said projectiles that has a generally oblong, closed container having a channel defined in its bottom from a distal axial end to an outlet port located in a lowermost, median portion of the container. The proximal portion of the container floor defines a slanted platform which extends above and beyond the outer port so that projectiles are urged by the platform toward the distal end of the channel from where they roll under the platform and into the outlet port. A helicoidal stirring arm projects from a distal area of the platform obliquely over the exposed part of the channel. The steering aim is driven by an electrical motor controlled by a switch conveniently mounted on the side of the magazine. The arm spins in a ball-uplifting direction to break any jamming of the balls above the channel. The outlet port extends into a tubular section having radial fins which allow the escape of blown-back gases between the tubular section and the internal wall of the marker projectile inlet.

Another solution is presented in U.S. Pat. No. 6,889,680 ("the '680 patent") issued to Christopher, et al. on May 10, 2005 which is directed to a ball feed mechanism for use in a paintball loader. The ball feed mechanism includes a feeder which conveys or impels balls toward a feed neck, and a drive member which is concentric with the impeller. The feeder is coupled to the drive member through a spring. The spring is configured to store potential energy which is used to rotate the feeder and, thus, drive the balls toward the feed neck. An electric motor is used to rotate the drive member to wind the spring. The feed mechanism includes sensors which detect the motion of the feeder and the drive member. A controller determines the spring tension based on the relative motion of the feeder and drive member, and actuates a motor when necessary.

Another solution is presented by U.S. Pat. No. 7,021,302 ("the '302 patent") issued to Neumaster, et al. on Apr. 4, 2006. The '302 patent teaches an impeller for an active-feed paintball loader with resilient arms that engage paintballs in the lower portion (well) of the loader and advance them to and through the outfeed tube. The resilient arms are sufficiently stiff to move unobstructed paintballs located between the arms, and sufficiently flexible to yield when forced against stationary paintballs so as not to rupture the paintball shells, the arms substantially returning to their original shape when the obstruction is removed. Accordingly, when the motor is shut off, the arms will simply flex backward as they encounter stationary paintballs. Should a paintball jam occur in the vicinity of the impeller, the arm(s) can flex around the jammed ball without breaking it, and help to dislodge it so as to clear the jam.

A need therefore exists for a simple and economical active-feed paintball loader that reliably feeds paintballs to the outfeed tube to ensure a rapid and steady supply of paintballs to the marker, while preventing (or at least greatly reducing the likelihood of) paintball breakage in the loader.

SUMMARY OF THE INVENTION

The present invention is directed to a motor control system for an active-feed paintball loader. In accordance with one exemplary embodiment of the present invention, an outfeed tube is provided using sensors for predictive ball sensing and paintball jam clearing of loaders. Of particular note is the use of multiple motor control schemes using outfeed tube sensing as predictive indicators of ball positioning for faster paintball loading operation.

In one embodiment, the invention is a loader defining a container and a feeder system that are configured to store and load paintballs from a loader to a marker. The loader includes an outfeed tube flowably connected to the marker with at least one ball sensor positioned in the outfeed tube of the loader. The sensor is connected to a controller that monitors the output of the sensor to control the motor in transferring paintballs from the loader to the marker.

The present invention utilizes an active feed mechanism to mechanically transfer paintballs from the loader to the marker. In active feed mode, the present invention consumes battery power in transferring paintballs from the loader to the marker. The present invention allows a user to turn the active feed mechanism on or off.

When the active feed mechanism is turned on, a user can select which mode the active feed mechanism should operate. In one embodiment of the present invention, the active feed mechanism operates in a continuous feed mode, reactive mode, or a pulse mode. The continuous feed mode allows users to choose a setting in which the motor continuously runs. The continuous mode uses significant battery power. In sensor mode, the motor runs only when the sensor does not detect a paintball obstructing the pathway of the paintball stack. The sensor mode uses power only when reacting to ball movement within the stack. When using the sensor, the loader functions in a reactive manner that activates the feeder to transfer paintballs from the loader to the marker once a gap is detected.

Finally, the pulse mode operates the motor in timed pulses that allows the loader to be proactive in transferring paintballs from the loader to the marker. The controller activates the motor to transfer paintballs from the loader to the marker even if a sensor detects a paintball. The controller may also perform the function of variably controlling the speed of the motor and the rotational speed of the feeder. In conjunction with a sensor (electro-mechanical actuator switch, infrared sensor, etc.) within the outfeed tube, the controller varies the speed of the motor to support the demand for paintballs. For example, if the outfeed tube is not full, more paintballs need to be supplied for entry into the paintball marker. The controller then sends a command to the motor to increase the RPM, thus increasing the supply of paintballs to the marker. If the outfeed tube is full, as detected by the sensor, the motor is stopped by the controller. As the demand for paintballs increases, the controller commands the incremental increase in power to the motor, resulting in an increase in RPM of the feeder. In existing devices, there are only two speeds associated with the motor, full speed or zero speed. With the use of the controller, the motor can be variably controlled to supply paintballs according to the demand of the marker operator. The use of the controller to variably control the speed of the motor may be utilized on any paintball marker loader requiring the use of a motor to feed paintballs to the paintball marker.

In the preferred embodiment of the present invention, the controller changes the speed of the motor by varying the duty cycle available to the motor. The duty cycle available to the motor is varied by pulse width modulation, which is a technique well known in the art of electronics. For example, the duty cycle is increased to increase the speed of the motor. Likewise, the duty cycle is decreased by the controller to decrease the speed of the motor. The power utilization of the motor is more efficient by utilizing pulse width modulation to vary the speed of the motor. With low power remaining in a battery, which may be sensed by the controller, the duty cycle may be decreased. This decrease in duty cycle available to the motor allows a battery to provide power to the motor for a longer period of time. Additionally, by utilizing pulse width modulation, any dc electrically powered motor may be used. Thus, an expensive multiple winding variable speed motor is not necessary to operate the paintball loader.

It is an object of the present invention to increase the speed with which a paintball loader transfers paintballs to a paintball marker.

It is also an object of the present invention to decrease the amount of power needed to operate a paintball loader while increasing the speed with which the loader transfers paintballs to a marker.

It is also an object of the present invention to proactively feed paintballs to a marker.

It is also an object of the present invention to prevent jams from occurring within the loader.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

FIGS. 1 through 5 of the drawings show various views of a loader and its operation associated with several embodiments of the present invention.

Figure 1:
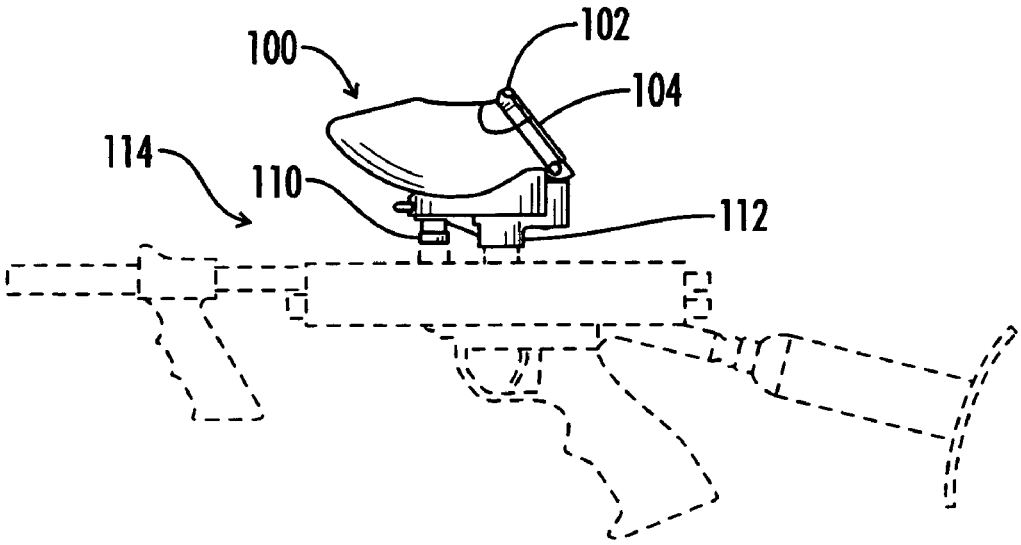
FIG. 1 is a side elevational view of one embodiment of the present invention operatively attached to a representative paintball marker.

FIG. 1 shows a side elevational view of a paintball loader 100 operatively attached to a representative paintball marker 114 illustrated in phantom. The paintball marker 114 includes a main body, a barrel, a grip, and a trigger. An infeed tube 112 of the paintball marker 114 is provided for connection to the outfeed tube 110 of the paintball loader 100. A compressed gas cylinder is attached to the marker 114. The paintball marker 114 also includes an inlet tube leading to a firing chamber (not shown) in the interior of the paintball marker 114. The compressed gas cylinder normally contains CO2, or compressed air, although any compressible gas may be used.

Figure 2:
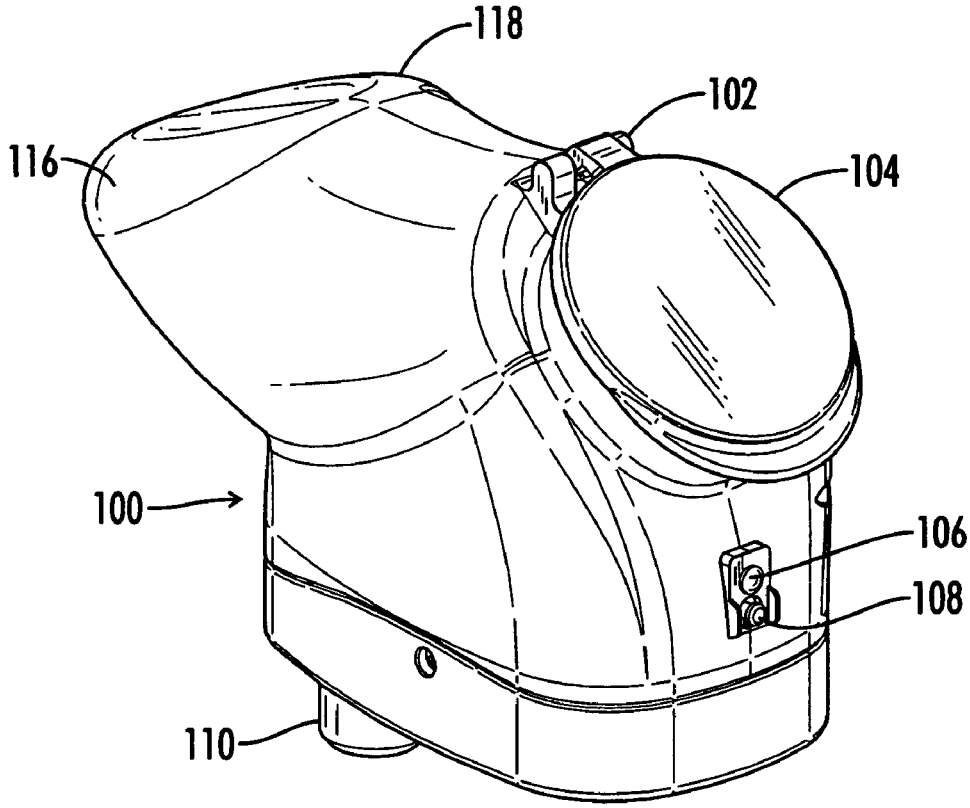
FIG. 2 is a perspective view of one embodiment of the present invention.

As shown in FIGS. 1 and 2, a paintball loader 100 includes a housing forming an interior chamber for receiving paintballs. The interior chamber leads to an outfeed tube 110. The outfeed tube 110 is positioned to feed paintballs to the infeed tube 112 of the paintball marker 114. The paintball loader 100 is coupled to the paintball marker 114 by inserting the outfeed tube 110 into the interior passageway of the infeed tube 112 such that an outer side surface of the outfeed tube 110 frictionally engages an inner side surface of the infeed tube 112 and the respective interior passageways thereof are in communication with each other. Paintballs are housed in the interior space of the paintball loader 100 until they are supplied, in a manner to be more fully described below, to the outfeed passageway 148 of the outfeed tube 110. The paintballs then drop through the outfeed passageway 148 of the outfeed tube 110 and the infeed tube 112 and into the firing chamber of the paintball marker 114.

Mounted on a rear end of the main body portion of the paintball loader 100 is a loader lid 104 that is removably attached such that the loader lid 104 can be opened to provide access into the interior area of the main body portion or closed to seal paintball loader 100. The loader lid 104 may also be pivoted around a hinge structure 102 to allow access to the interior area of the loader 100. Paintballs stored in the interior space of the loader 100 may be loaded through the rear end of the loader after the loader lid 104 has been opened.

Figure 3:
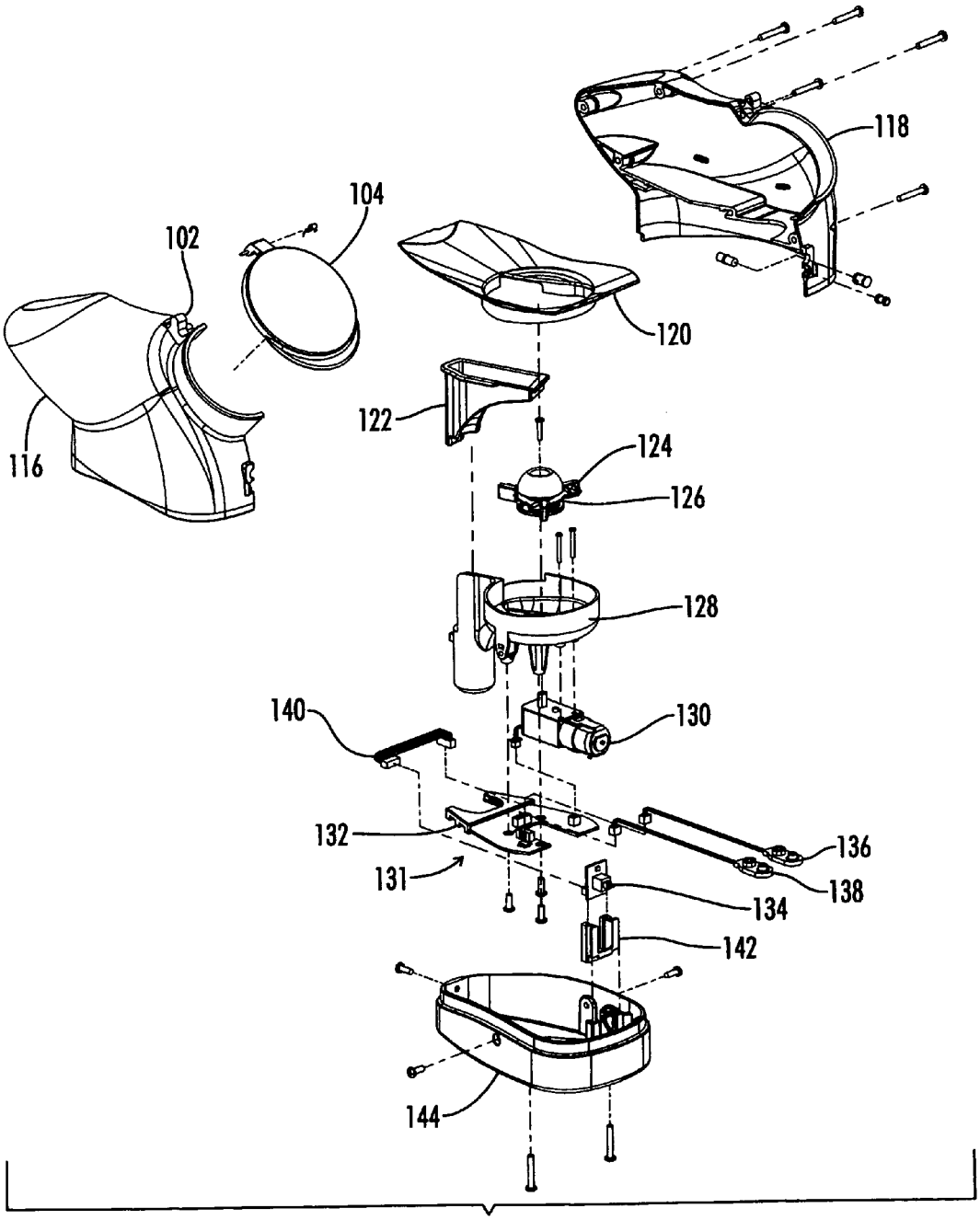
FIG. 3 is an exploded view thereof.
Figure 4:
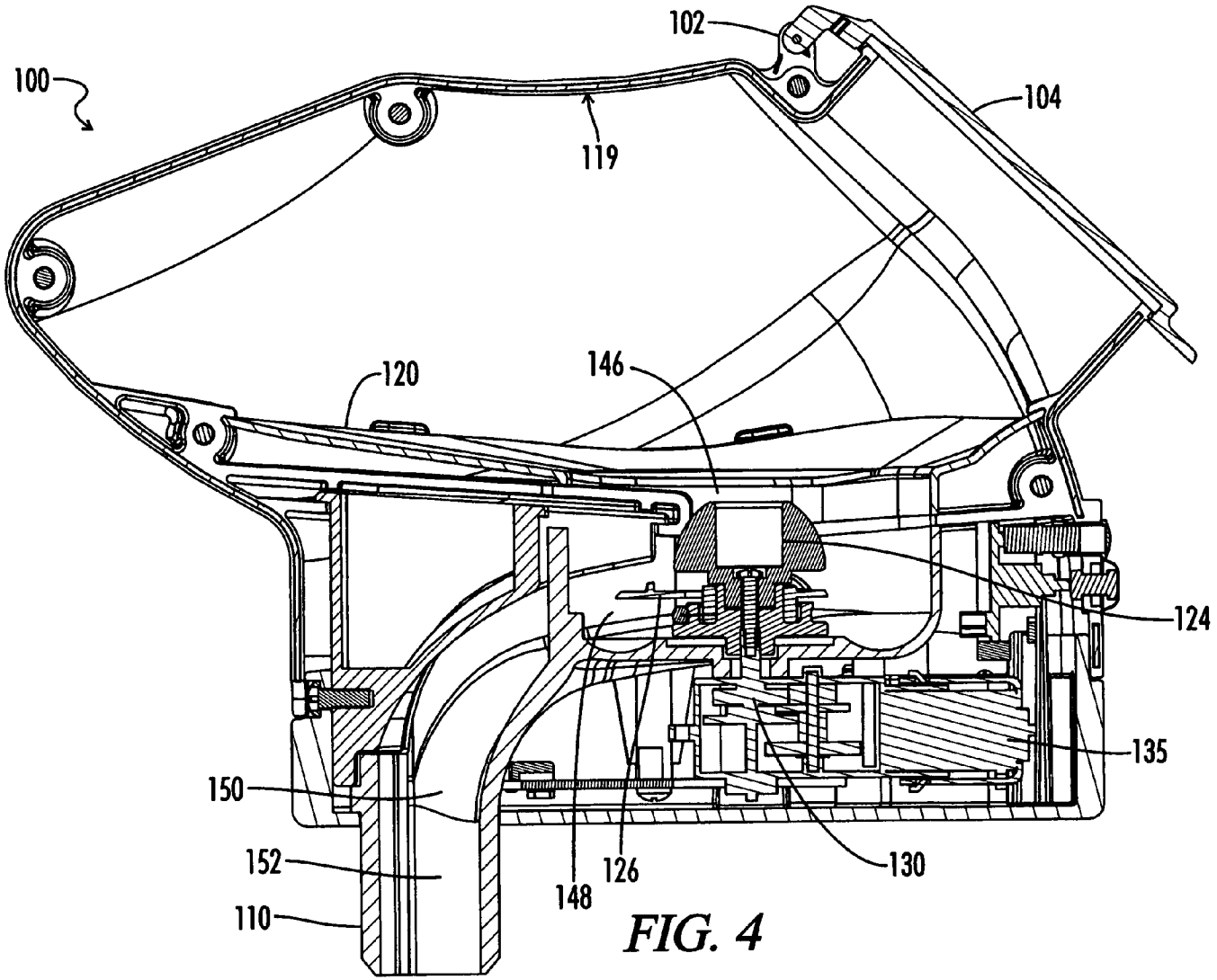
FIG. 4 is an internal view thereof.

Referring next to FIGS. 3 and 4, the paintball feed mechanism will now be described in greater detail. As may now be seen, top wall 119, ball ramp 120, first interior side wall formed by left shell 116, second interior side wall formed by right shell 118, front wall 115, the loader lid 104, the raceway 128, and the outfeed passageway 148 defines the active feed area of the loader 100. The paintballs placed in the interior area of the paintball loader 100 move through raceway 128, through outfeed passageway 148, finally through outfeed exit 154 of loader 100.

The paintball loader 100 also includes a ball ramp 120 which projects downwardly to the raceway 128. A rotatable feeder 124, which is one component of a paintball feed mechanism, is positioned within the raceway 128. An area between the raceway 128 and the loader base 144 stores the remaining components of the paintball feed mechanism. The remaining components include a motor 130 which drives the rotatable feeder 124, a power supply 135, for example, a 9 volt battery, which provides electric power for the motor 130, a controller 131 for activating the motor 130, and at least one sensor 150 for selectively activating the motor 130.

The feeder 124 is mounted above the raceway 128. Feeder 124 is coupled to the motor 130 such that motor 130 rotates feeder 124. The feeder 124 includes a central body portion from which a series of feeder arms 126 outwardly radiate, i.e. extend towards the side walls of raceway 128 such that paintballs will be held in recesses between a pair of adjacent feeder arms 126 and the side walls of raceway 128. For example, a paintball is held in a recess located between adjacent feeder arms 126. Preferably, a cover over the feeder 124 is generally dome-shaped to channel paintballs towards the recesses between feeder arms 126. In one embodiment, the feeder arms 126 are straight. In another embodiment, the feeder arms 126 are shaped to the curvature of the paintballs so that the recesses have a semi-circular shape and the feeder arms 126 are spaced sufficient distance apart to readily hold a paintball therebetween. As the feeder 124 rotates, the feeder arms 126 forcibly direct the paintballs towards an outfeed passageway 110 leading to outfeed exit 154.

FIG. 3 shows an exploded view of the present invention. The loader 100 includes a left shell 116 and a right shell 118. The loader 100 includes a loader lid 104 that is connected at hinge 102. Found inside loader 100, ball ramp 120 guides paintballs to the feeder 124. As the paintballs progress through the ball ramp exit 146 of ball ramp 120, the paintballs reach raceway 128 where the paintballs contact feeder arms 126 of feeder 124. As motor 130 rotates feeder 124, feeder arms 126 transfer paintballs through raceway 128 to the outfeed passageway 148. Ball guide 122 assists feeder arms 126 in transferring paintballs from the raceway 128 to the outfeed passageway 148. A power supply 135 is connected to battery harnesses 136, 138 to supply power to controller 131 and motor 130. In one embodiment, power supply 135 is two 9-Volt batteries. Secondary PC Board 134 is mounted to Mount Adapter 142 where it is installed to Loader base 144. Secondary PC Board 134 allows the user to select the mode, continuous feed mode, reactive feed mode, or pulse mode, in which the present invention operates.

The present invention provides users with the ability of switching between a number of modes of operating the active feed mechanism. A user can select between continuous feed, reactive feed, and pulse mode. The continuous feed mode allows users to choose a setting in which the motor 130 continuously rotates feeder 124. In reactive feed mode, the motor 130 rotates feeder 124 while the sensor 150 does not detect a paintball obstructing the pathway. In pulse mode, the motor 130 does not continuously rotate feeder 124. Instead, controller 131 activates and deactivates the motor 130 in pulses according to input to the controller 131 from at least one sensor 150.

The feed mechanism is turned on by manipulating the mode toggle 108. When the mode toggle 108 is manipulated such that the feed mechanism is activated, the motor 130 is activated according to communications received by the controller 131 from at least one sensor 150. The sensor 150 consists of an emitter for generating a beam of infrared light and a receiver for detecting the beam. The emitter and the receiver are positioned on opposite ends of the outfeed passageway 148 formed within the outfeed tube 110. For example, the sensor 150 may be mounted to an outer side surface of the outfeed passageway 148 such that infrared light generated by an emitter may pass through a first aperture across the outfeed passageway 148 and through a second aperture where it is detected by the sensor 150.

The present invention allows a user to turn the active feed mechanism on or off. When the active feed mechanism is turned on in the embodiment shown, a user can select continuous feed mode, reactive feed mode, or pulse mode. The user selects the mode for the active feed mechanism by manipulating the mode toggle 108. In one embodiment, a user must hold the mode toggle 108 down to activate the active feed mechanism. The user can then select reactive feed mode or pulse mode by manipulating the mode toggle 108. Mode indicator 106 informs a user as to whether the active feed mechanism is on and the mode of operation of loader 100. To turn the active feed mechanism off again, a user holds the mode toggle 108 down for a period of time.

In reactive feed mode, the motor 130 continuously rotates feeder 124 while the sensor 150 does not detect a paintball obstructing the pathway of the paintball stack. The loader 100 functions in a reactive manner that activates the feeder 124 to transfer paintballs from the loader 100 to the marker 114 once a gap is detected. The reactive feed mode will be described in greater detail below.

The pulse mode operates the motor 130 in timed pulses that allows the controller 131 to adjust the speed in which the feeder 124 rotates to transfer paintballs from the loader 100 to the marker 114. In pulse mode, the controller 131 activates the feeder 124 to transfer paintballs from the loader 100 to the marker 114 even if a sensor 150 detects a paintball. A controller 131 activates and deactivates the motor 130 in pulses according to input received by the controller 131 from at least one sensor 150. The pulse mode will be described in greater below.

In the off mode, the present invention no longer consumes battery power to transfer paintballs to the marker 114. Instead, the slope of ball ramp 120 and the raceway 128 of the present invention gravitationally transfer the paintballs to the marker 114.

The operation of the paintball loader 100 in providing a reactive feed of paintballs to the paintball marker 114 will now be described in greater detail. Starting from a fully loaded condition where a stack of paintballs extends through the interior passageways of the infeed tube 112 and the outfeed tube 110, at least one paintball of the paintball stack blocks the infrared beam generated by the emitter from reaching the sensor 150. The sensor 150 will notify the controller 131 that a paintball has been detected. Therefore, the controller 131 deactivates the motor 130. As the paintball marker 114 is fired, paintballs in the stack will be dropped, in sequence, into the firing chamber. As depletion of the stack of paintballs begins, the paintball blocking the infrared beam from reaching sensor 150 will drop lower into the stack and, since no additional paintballs are being forced through the outfeed passageway 148 and into the outfeed tube 110, the sensor 150 will detect the infrared beam being generated by the emitter. The controller 131 will activate the motor 130 after receiving the input from sensor 150. The motor 130 will cause the feeder 124 to rotate and start timing how long it takes a ball to drop into a position. The feeder 124 can rotate either in a clockwise or counterclockwise direction so that if a jam occurs and it takes too long for a ball to drop, the feeder 124 can be reversed and then moved forward again to clear the jam.

As the feeder 124 rotates, paintballs retained in the recesses between a pair of adjacent feeder arms 126 and the raceway 128 are forcibly directed out of the raceway 128 and into the outfeed passageway 148. As the paintballs enter the outfeed passageway 148, additional paintballs drop into the recently vacated recesses between the feeder arms 126 where the paintballs are retained and forcibly directed towards the outfeed passageway 148 by continued rotation of the feeder 124. When the infrared beam is again blocked, the controller 131 deactivates the motor 130 and stops the feeder 124 from further rotation.

Figure 5:
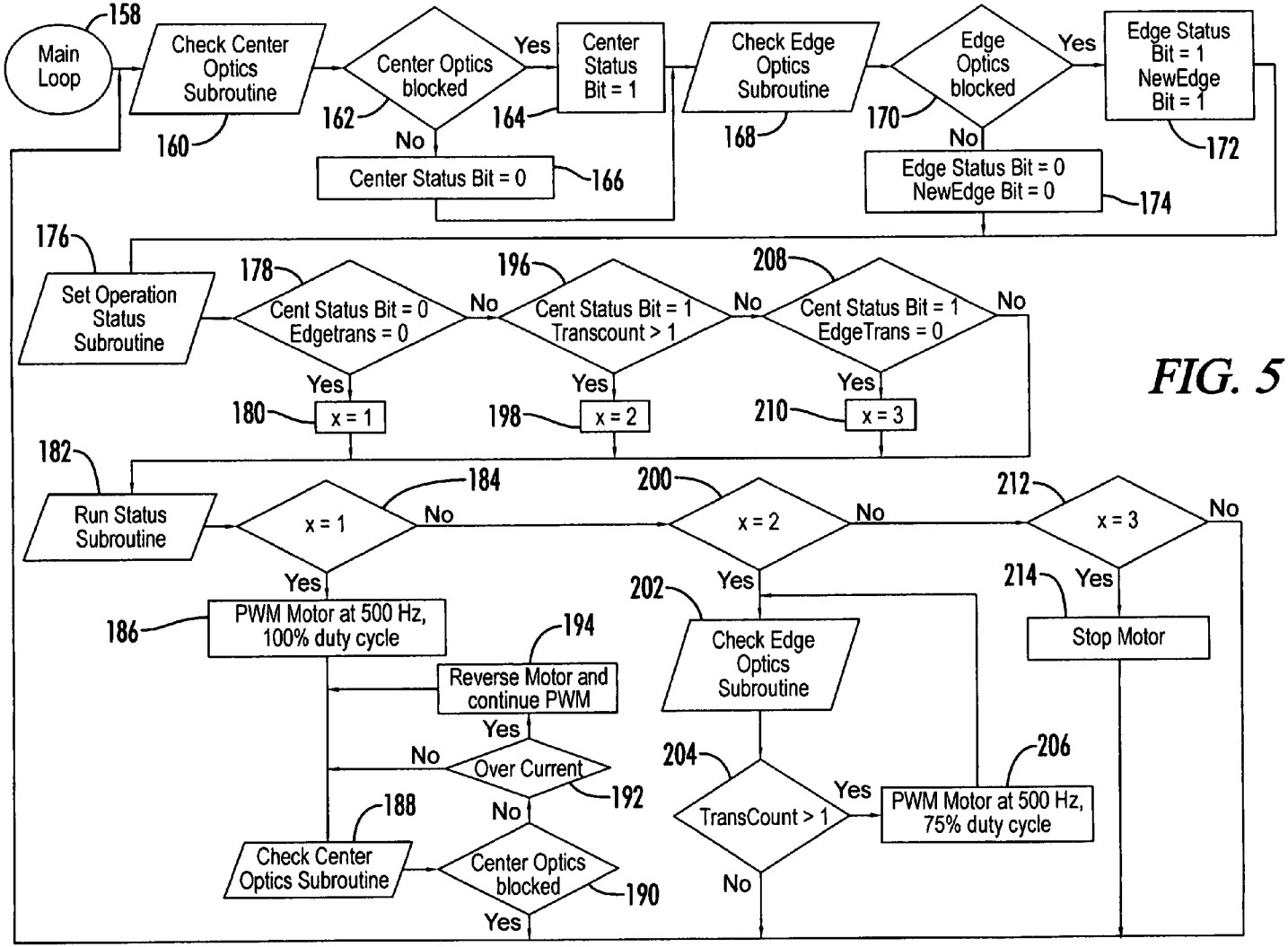
FIG. 5 is a diagrammatic representation of a flowchart illustrating the control program thereof.

Referring to FIGS. 4 and 5, the operation of the paintball loader 100 in a pulse mode will now be described in greater detail. A paintball loader 100 including a feed mechanism according to one embodiment of the present invention includes a controller 131 in communication with at least one sensor 150 for controlling the operation of the paintball loader 100. The controller 131 and center optic 150 and edge optic 152 are shown in FIGS. 3 and 4. A sensor 150 may be placed at a preselected location in the loader 100, such as, for example, adjacent or in the outfeed passageway 148. The sensor 150 for detecting the presence or absence of a paintball, or the movement of a paintball stack, and may be a mechanical, contact, piezoelectric, optical, infrared, or other type of sensor, and may include an emitter and a receiver. The sensor 150 is in communication with the controller 131, which can send a signal to either activate the motor 130 (when paintballs are required by the paintball marker 114 to which the loader 100 is attached), to deactivate the motor 130 (when a paintball stack is stationary and/or the paintball marker 114 is not firing), or to reverse the motor 130 (when a paintball jam occurs). The controller 131 can also be set to control other operations of the paintball loader 100, such as varying the speed of the motor 130 in either a forward or reverse operation of the motor 130.

A sensor 150 is located in the outfeed tube 110 of a loader 100 to detect the progress of at least one paintball through the outfeed tube 110 and into the infeed tube 112 of the marker 114. An additional sensor 152 is located at a second preselected location in the loader housing, such as the outfeed tube 110 of the loader 100. The two sensors detect transitions of paintballs as the paintballs progress through the loader 100 and into the marker 114. The center optic 150 and edge optic 152 detect transitions caused by an empty gap in the paintball stack or paintball movement through the present invention. As the paintballs travel through the loader, each sensor 150, 152 detects the transitions of the paintballs through the loader.

In controlling the motor 130, the present invention utilizes center optic 150 and edge optic 152 to determine placement of paintballs in the outfeed tube 110 of the loader 100. In one embodiment of the invention, the center optic 150 and edge optic 152 are placed at different preselected locations of the outfeed tube 110. In one embodiment of the present invention, a first sensor 150 is placed in the center of the outfeed tube 110, the center optic, 150. A second sensor 152 is placed on the edge of the outfeed tube 110, the edge optic 152. The center and edge optics 150, 152 communicate with the controller 131 to determine the operation of the motor 130.

As shown in FIG. 5, one embodiment of the control scheme of the present invention will be described. The control scheme is initiated at main loop 158. In the first iteration of the loop, all variables are initialized to 0. Center status bit, edge status bit, newedge bit, edgetrans, and transcount are set to 0. Center status bit indicates that the center optic 150 detects a paintball. The present invention assigns a value to edge status to indicate that the edge optic 152 detects a paintball. In addition, when edge optic 152 detects a paintball, the present invention assigns newedge bit a value to denote that the edge optic is blocked. Edgetrans indicates transitions of paintballs through outfeed tube 110 during the main loop 158 of the control scheme of the present invention. As the edge optic 152 continues to detect paintball transitions through outfeed tube 110, the present invention increments transcount to represent the number of transitions of paintballs.

For the first step of the main loop 158 of the control scheme of the present invention, the present invention initiates the check center optics subroutine 160 to detect whether a paintball is currently detected by center optic 150. The present invention utilizes a center status bit to indicate whether the center optic 150 detects a paintball. If the center optic 150 is blocked by a paintball at center optic query 162, the controller 131 sets the center status bit to 1 to indicate that center optic 150 detects a paintball at set center status bit 164. If the center optic 150 is not blocked by a paintball at center optic query 162, the controller sets the center status bit to 0 to indicate that the center optic 150 does not detect a paintball at set center status bit 166.

After completing the check center optic subroutine 160, the present invention initiates the check edge optic subroutine 168. During the check edge optic subroutine 168, the present invention determines whether the edge optic 152 is blocked by a paintball. The present invention also assigns a value to edge status, newedge, newedge, edgetrans, and transcount during check edge optic subroutine 168. The present invention utilizes an edge status bit to indicate whether the edge optic 152 detects a paintball. If the edge optic 152 is blocked by a paintball at edge optic query 170, the present invention progresses to the set edge status 172. At set edge status 172, the controller 131 sets the edge status bit to 1 to indicate that the edge optic 152 detects a paintball. At set edge status 172, the present invention also sets the newedge bit to 1. If the edge optic is not blocked by a paintball, the present invention progresses to set edge status 174. At set edge status 174, the controller sets the edge status bit to 0 to indicate that the edge optic 152 does not detect a paintball and assigns newedge bit to 0 to indicate that the edge optic 152 does not detect a paintball.

If the newedge bit changes during the loop, the controller 131 sets the edgetrans bit to 1 during the check edge optics subroutine 168. If the newedge bit does not change, the controller 131 sets the edgetrans bit to 0. As long as the edgetrans bit is equal to 1 on each cycle of the loop, transcount is incremented. However, if edgetrans equals 0 during three iterations of the loop, the controller resets transcount to 0. Other embodiments of the present invention require edgetrans to equal 0 for at least two iterations of the loop before the controller resets transcount to 0.

The present invention then initiates the set operation status subroutine 176. One embodiment of the present invention allows three different mode of operation: a full operation, a partial operation, and a stopped operation. The three different mode of operation allow the feeder 124 to operate in three different manners. The present invention utilizes three queries to determine the mode in which the controller 131 should operate the motor 130, full operation query 178, partial operation query 196, and stopped operation query 208. In the full operation query 178, the present invention detects whether the paintballs are moving through the outfeed tube 110 and whether storage space remains for additional paintballs to be transferred to the outfeed tube 110. During full operation query 178, the present invention determines whether both the center status bit and edgetrans equal 0. If full operation query 178 is true, the present invention sets the mode to full operation at set full operation 180. The partial operation query 196 of the present invention determines if the paintball stack is continuous, but moving through the outfeed (center status bit equals 1 and transcount is greater than 1). If partial operation query 196 is true, the present invention sets the mode to partial operation at set partial operation 198. The stopped operation query 208 determines if the paintball stack is full and not moving (center status bit is set to 1 and that edgetrans is equal to 0). If stopped operation query 208 is true, the present invention sets the mode to stopped operation at set stopped operation 210. The present invention then initiates the run status subroutine 182.

If the present invention is in full operation mode at full operation status query 184, the controller 131 operates the motor 130 in full operation. In one embodiment of the present invention, the full operation mode operates the motor at 100% duty cycle at 500 Hz as shown at set motor to full operation step 186. After activating the motor 130, the present invention initiates the check center optics subroutine 188. If the center optic 150 is blocked at center optic query 190, the present invention continues to operate the motor in full operation mode. The controller program then transitions to check center optics subroutine 160 at the beginning of the main loop 158.

In one embodiment, the controller 131 may also be used to monitor jams within the paintball loader 100. If the center optic 150 is not blocked at center optic query 190, the present invention detects whether the loader 100 is jammed at jammed query 192. The present invention monitors paintball jams by either monitoring the current of motor 130 or detecting paintball transitions over time. In the embodiment of the present invention that utilizes monitoring of the current, a sensor monitors the current of the motor to detect rises in the current. If paintballs jam within the paintball loader 100, the motor 130 experiences additional resistance in rotating the feeder 124. The additional resistance produces increased torque on the motor 130 and a rise in electrical current. The rise in electrical current is detected by controller 131 at jammed query 192. Upon detection of the rise in electrical current, the controller 131 reverses the motor 130 and continues the pulse width modulation to clear paintball jams occurring within the loader 100 at reverse motor step 194. The program will progress to the check center optics subroutine 188 and continue the loop until the center optic 150 is blocked at center optic query 190 as shown in FIG. 5. Once the center optic is blocked at center optic query 190, the present invention initiates the check center optics subroutine 160.

If the controller 131 does not detect a rise in electrical current at step 192, the controller 131 continues to operate the motor 130 in full operation mode. The present invention progresses to check center optic subroutine 188 of the programming diagram and continue the loop until the center optics 150 is blocked at step 190. Once the center optic 150 is blocked at center optics query 190, the present invention initiates the check center optics subroutine 160.

The controller 131 also variably controls the speed of the motor 130 and the rotational speed of the feeder 124. If the present invention has set the mode to partial operation at partial operation status query 200, the controller 131 does not activate the motor 130 to run at full speed. In conjunction with a sensor 150 (electro-mechanical actuator switch, infrared sensor, etc.) within the outfeed passageway 148, the controller 131 varies the speed of the motor 130 to support the demand for paintballs. For example, if the outfeed passageway 148 is not full, more paintballs need to be supplied for entry into the paintball marker 114. The controller 131 then sends a command to the motor 130 to increase the RPM, thus increasing the supply of paintballs to the marker 114.

In the preferred embodiment of the present invention, the controller 131 changes the speed of the motor 130 by varying the duty cycle available to the motor 130, rather than changing the voltage delivered to the motor 130. The duty cycle available to the motor is varied by pulse width modulation, which is a technique well known in the art of electronics. For example, the duty cycle is increased to increase the speed of the motor 130. Likewise, the duty cycle is decreased by the controller 131 to decrease the speed of the motor 130. The power utilization of the motor 130 is more efficient by utilizing pulse width modulation to vary the speed of the motor 130. With low power remaining in power supply 135 which may be sensed by the controller 131, the duty cycle may be decreased. This decrease in duty cycle available to the motor 130 allows a power supply 135 to provide power to the motor 130 for a longer period of time. Additionally, by utilizing pulse width modulation, any dc electrically powered motor may be used. Thus, an expensive variable speed motor is not necessary to operate the paintball loader 100.

In one embodiment of the partial operation mode of the present invention, the control program initiates the check edge optics subroutine 202. As described above, the check edge optics subroutine 202 determines whether the edge optic 152 is blocked by a paintball and detects paintball transitions. If a paintball is detected by edge optic 152 at check edge optics subroutine 202, the present invention sets edge status bit and newedge bit to 1. If a paintball is not detected by edge optic 152 at check edge optics subroutine 202, the present inventions sets edge status bit and newedge bit to 0. The controller 131 then determines whether a paintball transition has occurred. If the newedge bit changes during the loop, the controller 131 sets the edgetrans bit to 1. If the newedge bit does not change, the controller 131 sets the edgetrans bit to 0. As long as the edgetrans bit is equal to 1 on each cycle of the loop, the present invention increments transcount by 1. However, if edgetrans equals 0 during three iterations of the loop, the controller 131 resets transcount to 0. At transition query 204, the present invention determines whether paintball transitions are occurring within loader 100. If transcount is greater than 1, the paintball stack is moving, but it is not moving quickly. Thus, the present invention reduces the motor speed. The present invention can then reduce the speed of the motor 130 to operate at 500 Hz, 75% duty cycle. The present invention will then run check edge optics subroutine 202. If transcount is not greater than 1 at transition query 204, the present invention returns to check center edge optics subroutine 160.

If the mode of the present invention is set to stopped operation at stopped operation query 212, the controller 131 stops the motor at stop motor 214. After stopping the motor 130, the controller 131 proceeds to check center optic subroutine 160.

In another embodiment, the present invention utilizes a controller 131 in communication with a sensor to activate the motor 130 at particular fixed speeds. The sensor communicates with controller 131 to operate the motor at one of its multiple speeds. In this embodiment, the sensor detects transitions of the paintball stack through the outfeed passageway 148. The controller 131 utilizes a clock to determine the number of paintball transitions during a particular clock cycle. By detecting the number of transitions during a particular clock cycle, the loader predicts the paintball usage over time in order to activate the motor 130 in a proactive manner instead of reactive. As the number of paintball transitions increases during a clock cycle the controller activates the motor at an increased duty cycle. As the number of paintball transitions decreases, the controller decreases the duty cycle. In one embodiment, if the sensor detects a paintball transition per clock cycle, the controller 131 activates the motor 130 at 33% duty cycle. If the sensor detects two paintball transitions per clock cycle, the controller 131 activates the motor 130 at 66% duty cycle. If the sensor detects three paintball transitions per clock cycle, the controller 131 activates the motor 130 at 100% duty cycle. In other embodiments, the clock cycle, the number of speeds at which the motor is operated, as well as the number of transitions per cycle required to determine the speed at which to operate the motor can vary according to a particular user's needs.

In another embodiment, if the sensor 152 does not detect paintball transitions after several clock cycles, the controller 131 activates the motor at 100% duty cycle to force paintballs through the outfeed passageway 148. If the sensor 152 does not detect a paintball transition after a number of clock cycles, the controller 131 determines that a jam has occurred and reverses the motor 130 to clear the jam. If the sensor 152 continues to not detect paintball transitions, the controller 131 determines that there are no more paintballs in the loader and stops running the motor.

In another embodiment, the present invention utilizes a full stack sensor to determine the stack condition. In this embodiment, the full stack sensor can be a second sensor such as an optical sensor or a motor current sensor that detects increased current to the motor caused by jams in the present invention. The present invention continues to operate in a similar manner described above by operating the motor 130 at a duty cycle according to the number of detected paintball transitions. The full stack sensor allows the present invention to determine the current status of the stack instead of depending upon the clock as described above.

In the embodiment in which the full stack sensor is a second sensor similar to the first sensor, the full stack sensor detects the presence of a paintball. As long as the first sensor continues to detect paintball transitions, the present invention does not detect a jam. Once the sensor fails to detect paintball transitions, the controller communicates with the full stack sensor, in this embodiment, the second sensor, to determine the status of the stack. If the full stack sensor detects a paintball, the outfeed passageway 148 is full. Therefore, the present invention will not operate the motor 130 until the sensor detects a paintball transition. If the full stack sensor does not detect a paintball, outfeed passageway 148 is not full and the paintball stack is not full. Therefore, the motor 130 will continue to rotate feeder 124 to feed paintballs to outfeed passageway 148.

In another embodiment, the full stack sensor is a motor current sensor. The motor current sensor determines paintball jams by detecting the current of the motor 130. As long as the sensor continues to detect paintball transitions, the present invention will not detect a jam. When the present invention fails to detect paintball transitions, the present invention communicates with the full stack sensor, in this embodiment, the motor current sensor. If the motor current sensor does not detect a rise in the motor current, a jam has not occurred and the present invention will continue to run the motor 130 because the motor current sensor has not detected a full paintball stack. If a rise in the motor current does occur, the present invention detects a full paintball stack and will slow or stop motor 130.

Figure 6:
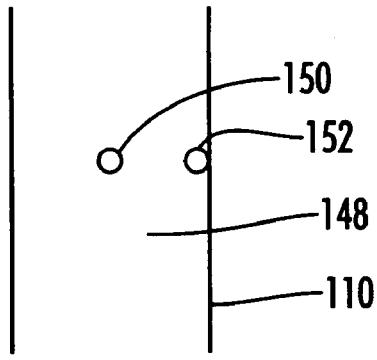
FIG. 6 is an internal view of an outfeed tube of one embodiment of the present invention.

FIG. 6 is an internal view of the outfeed tube 110 of the present invention. As shown in FIG. 6, the center optic 150 and the edge optic 152 are located so that center optic 150 and edge optic 152 detect paintballs as they pass through outfeed passageway 148. In FIG. 6, neither the center optic 150 nor the edge optic 152 detect a paintball. Therefore, controller 131 will assign center status bit to 0, edge status bit to 0, and newedge bit to 0.

Figure 9:
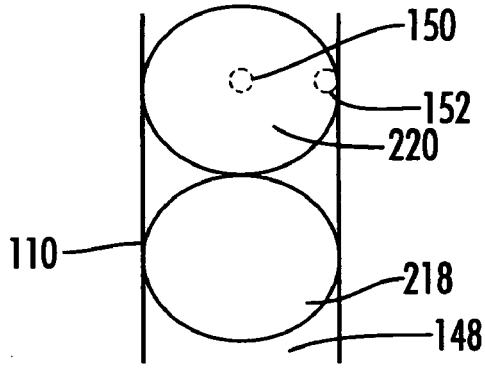
FIG. 9 is an internal view of the outfeed tube.
Figure 7:
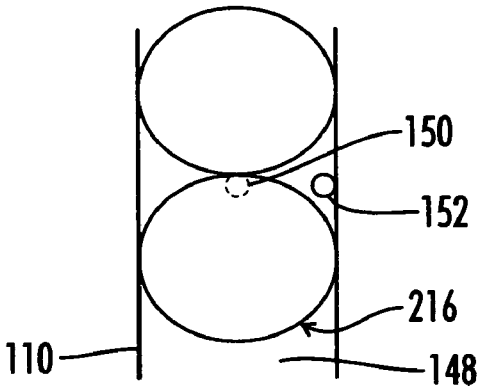
FIG. 7 is an internal view of the outfeed tube.
Figure 8:
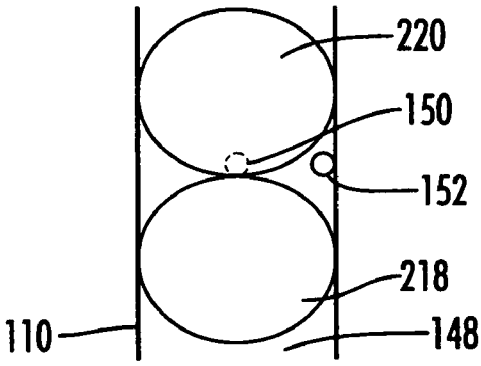
FIG. 8 is an internal view of the outfeed tube.

FIGS. 7, 8, and 9 show the progression of the paintball stack 216 through outfeed passageway 148. As seen in FIG. 7, the paintball stack blocks center optic 150. However, edge optic 152 is not blocked by the paintball stack 216. Therefore, the present invention will set the center status bit to 1, edge status bit to 0, and newedge bit to 0.

FIG. 8 shows paintballs 218, 220 in transition. Paintballs 218, 220 block center optic 150 and do not block edge optic 152. Therefore, center optic 150 detects paintballs 218, 220 and edge optic 152 does not detect paintballs 218, 220. The present invention will set center status bit to 1, edge status bit to 0, and newedge bit to 0.

FIG. 9 shows the transition of paintballs 218, 220 during the subsequent initiation of check edge optics subroutine 168 after the previous initiation of check edge optics subroutine 168 shown in FIG. 8. In FIG. 9, the center optic 150 and edge optic 152 are both blocked by a paintball 220 such that the center optic 150 and edge optic 152 detect paintball 220. The present invention will set center status bit to 1, edge status bit to 1, and newedge bit to 1. During the transition of paintballs 218, 220 from FIG. 8 to FIG. 9, the present invention assigns newedge to 1. As newedge bit changes from 0 to 1, the present invention assigns edgetrans to 1 and increments transcount by 1.

Figure 10:
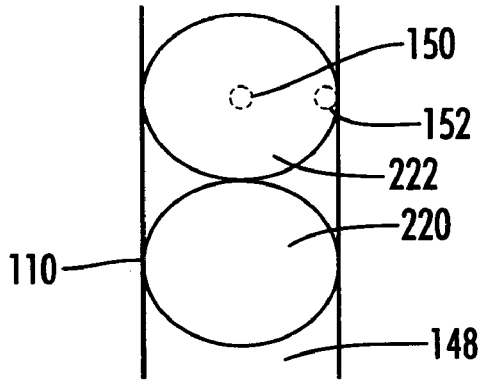
FIG. 10 is an internal view of the outfeed tube.

FIG. 10 shows an internal view of the downfeed tube 110 during the subsequent iteration of main loop 158 after the iteration shown in FIG. 9. In FIG. 10, center optic 150 and edge optic 152 detect paintball 222. Therefore, the present invention sets center status bit to 1, edge status bit to 1, and newedge bit to 1. Because newedge bit was previously assigned a value of 1 in the iteration shown in FIG. 9 and did not change from 0 to 1, the present invention assigns edgetrans to 0. Transcount remains the same value.

Figure 11:
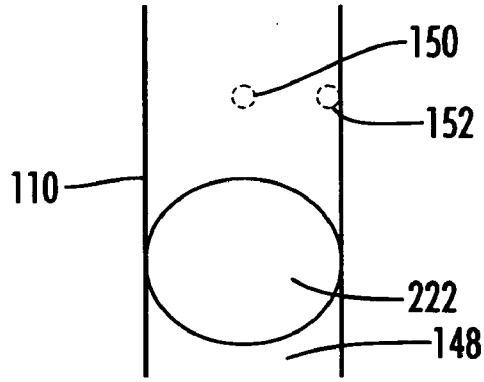
FIG. 11 is an internal view of the outfeed tube.

FIG. 11 shows the next iteration of the main loop 158 after the iteration found in FIG. 10. Center optic 150 and edge optic 152 do not detect paintball 222. Therefore, the present invention sets center status bit to 0, edge status bit to 0, and newedge bit to 0. In the iteration from FIG. 10 to FIG. 11, newedge bit changes from 1 to 0. The present invention sets edgetrans to 0 because of the change of newedge bit from 1 to 0. Further, the present invention does not increment transcount. If check edge optic subroutine 168 continues to fail to detect a paintball edge after initiating subsequent calls of check edge optic subroutine 168, the present invention sets transcount to 0. In one embodiment of the present invention, the check edge optic subroutine sets transcount to 0 after detecting that edgetrans is set to 0 during three consecutive calls of the check edge optic subroutine.

Reference numerals used throughout the detailed description and the drawings correspond to the following elements:

Paintball loader 100
Lid Hinge 102
Loader Lid 104
Mode Select Button 106
Active Feed Toggle 108
Outfeed Tube 110
Infeed Tube 112
Marker 114
Front wall 115
Left Shell 116
Right Shell 118
Top wall 119
Ball ramp 120
Ball Guide 122
Feeder 124
Feeder Arm 126
Raceway 128
Motor 130
Controller 131
Primary PC Board Assembly 132
Secondary PC Board 134
Power supply 135
Primary Battery Harness 136, 138
Secondary Harness 140
Mount Adapter 142
Loader Base 144
Feeder Bottom Exit 146
Active feed space 147
Outfeed passageway 148
Center Optic 150
Edge Optic 152
Outfeed Exit 154
Main loop 158
Check center optics subroutine 160
Center optics query 162
Center optics blocked 164

Center optics clear 166
Check edge optics subroutine 168
Edge Optic query 170
Set edge status 172
Set edge status 174
Set Operation Status Subroutine 176
Full Operation query 178
Set Full Operation 180
Run Status Subroutine 182
Full Operation Status query 184
Set Motor to Full Operation 186
Full Operation Check Center Optics Subroutine 188
Center Optic query 190
Paintball Jam query 192
Reverse Motor 194
Partial Operation query 196
Set Partial Operation 198
Partial Operation Status query 200
Partial Operation Check Edge Optics Subroutine 202
Transition query 204
Set Motor to Partial Operation 206
Stopped operation query 208
Set Stopped Operation 210
Stopped operation query 212
Stop Motor 214
Paintball stack 216
Paintball 218
Paintball 220
Paintball 222

From the foregoing, it will be seen that this invention is well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. A method for controlling a feeder of a paintball loader, the loader including an outfeed tube defining a center axis and an edge distally spaced from the center axis and parallel to the center axis, the loader also including a clock defining a clock cycle, the method comprising:

providing at least one edge sensor aimed away from the center axis and aimed toward the area between the center axis and the edge of the outfeed tube to detect the rate of paintball movement in the outfeed tube of a loader;

detecting a number of paintball transitions occurring within a clock cycle to determine the rate of paintball movement; and activating the motor at a duty cycle according to the number of paintball transitions occurring within the clock cycle.

2. The method of claim 1 further comprising:

detecting a side edge of a paintball to determine the number of paintball transitions occurring within the clock cycle.

3. The method of claim 1 further comprising:

monitoring the status of the paintball stack with a paintball stack sensor.

4. The method of claim 3 further comprising:

monitoring the status of the paintball stack by detecting a paintball in a predetermined position in the outfeed tube.

5. The method of claim 3 further comprising:

monitoring the status of the paintball stack by detecting the motor current.

6. The method of claim 3 further comprising:

activating the motor at a particular duty cycle according to the status of the paintball stack and the number of paintball transitions occurring during the clock cycle.

7. A method for controlling a feeder of a paintball loader using a controller, the loader including an outfeed tube defining a center axis and an edge distally spaced from the center axis and parallel to the center axis, the method comprising:

providing at least two sensors positioned to monitor a paintball feed in the outfeed tube of a loader, the two sensors located at two separate locations within the loader, the first sensor aimed to detect paintball transitions at the center axis of the outfeed tube, the second edge sensor aimed away from the center axis and aimed toward the area between the center axis and the edge of the outfeed tube;

monitoring the number of paintball transitions occurring within a clock cycle; and activating the motor at a duty cycle according to the number of paintball transitions occurring within a clock cycle and the status of the paintball stack.

8. The method of claim 7 further comprising:

activating the motor at less than 100% duty cycle but greater than 0% duty cycle if the second sensor detects that the status of the paintball stack is full and the number of paintball transitions is greater than zero during the clock cycle.

9. The method of claim 8 further comprising:

detecting a paintball at a predetermined location within the outfeed tube of the loader to determine if the paintball stack is full.

10. The method of claim 8 further comprising:

detecting the current of the motor to determine if the paintball stack is full.

11. The method of claim 7 further comprising:

stopping the motor if no paintball transitions occur during the clock cycle and the status of the paintball stack is full.

* * * * *